United States Patent [19]

Gorman

[11] 4,212,750

[45] Jul. 15, 1980

[54] METAL WORKING LUBRICANT

[75] Inventor: Jeremy W. Gorman, West Simsbury, Conn.

[73] Assignee: Lubrication Technology, Inc., Weatogue, Conn.

[21] Appl. No.: 860,682

[22] Filed: Dec. 15, 1977

[51] Int. Cl.[2] ..... C10M 1/06; C10M 3/38; C10M 3/32

[52] U.S. Cl. ..... 252/32.5; 252/33.2; 252/33.4; 252/49.5; 72/42

[58] Field of Search ..... 252/49.5, 33.4, 32.5; 72/42

[56] References Cited

U.S. PATENT DOCUMENTS

| | | | |
|---|---|---|---|
| 2,499,028 | 2/1950 | Kunze | 252/49.5 |
| 2,848,416 | 8/1958 | Gililland et al. | 252/33.4 |
| 2,907,714 | 10/1959 | Francis et al. | 252/33.3 |
| 2,912,384 | 11/1959 | Vierk et al. | 252/74 |
| 3,202,607 | 8/1965 | Koch | 252/49.5 |
| 3,223,648 | 12/1965 | Plapper et al. | 252/312 |
| 3,227,652 | 1/1966 | Ackerman | 252/49.5 |
| 3,235,510 | 2/1966 | Collings et al. | 252/395 |
| 3,501,404 | 3/1970 | Klaiber et al. | 252/49.5 |
| 3,813,337 | 5/1974 | Sheldahl | 252/33.4 |
| 3,933,660 | 1/1976 | Tadenuma et al. | 252/49.5 |
| 3,933,661 | 1/1976 | Abrains | 252/49.5 |

*Primary Examiner*—W. J. Shine

[57] ABSTRACT

A water base metal working lubricant includes water soluble polyalkylene glycols, a water emulsifiable high pressure lubricant component, which may be a chlorinated paraffin or a sulfurized or chlorinated fatty acid ester, and a non-ionic or anionic emulsifier for the high pressure lubricant. The latter is provided by a salt of a fatty acid sulfonate or sulfate, or a phosphate organic acid or ester of a fatty acid. The mixture may also include anticorrosives and a bactericide.

22 Claims, No Drawings

METAL WORKING LUBRICANT

BACKGROUND OF THE INVENTION

The present invention relates to metal working lubricants and, in particular, to water base metal working lubricants. Lubricants are employed in metal working operations such as cutting, rolling, drawing and milling in order to reduce friction and heat and thereby wear and tear on the metal working tools and in general to facilitate the metal working operation.

The use of lubricants is, of course, a standard expedient in the art and both petroleum oil base and water base lubricants are well known. Generally, oil base lubricants provide excellent lubricity but have a tendency to form undesirable deposits and excessive smoke at high temperatures. Water base lubricants do not have these disadvantages and, because of the high specific heat of water, display generally superior cooling ability. Water base lubricants do have a tendency to cause rusting or corrosion of the tools and metal. However, suitable anticorrosive additives can control the corrosion problem and water base systems find wide employment because of the above-mentioned advantages.

There are two general types of water base metal working lubricants. The soluble type uses ingredient additives which are soluble in the water base to form a true solution. The emulsion type contains water emulsifiable ingredients which are emulsified in the water base by emulsifiers and remain suspended in the water as minute droplets. There are certain characteristics of each of these two types of water base lubricants. Performance of water soluble lubricants tends to fall off at a fairly uniform rate as the concentration of the effective ingredients diminishes with repeated use of the lubricant so that performance corresponds rather closely to the concentration of the soluble ingredients remaining in solution. On the other hand, emulsion type water base lubricants tend to maintain fairly uniform performance characteristics over rather protracted periods of use until the dilution factor becomes so great as to interfere with their effectiveness. At this point, performance falls off rather abruptly.

Thus, the emulsion type water base lubricant has the advantage of generally uniform performance characteristics throughout most of its useful life but has the disadvantage of requiring that care be taken to maintain the active ingredients in emulsion. Both water base types usually require additives to control the formation of bacteria in the lubricant during storage or use and to control the corrosive effects of water on many of the metals on which the lubricant is used.

Numerous different formulations for water base metal working lubricants are, of course, known. For example, U.S. Pat. No. 3,813,337 discloses a metal working lubricant which includes a lubricating oil, a noncationic emulsifier, an overbased alkali metal or alkaline earth metal sulfonate, a chlorinated hydrocarbon component and a coupling agent in a stabilizing amount of water. The composition is combined with a major amount of water to form an aqueous emulsion.

U.S. Pat. No. 3,933,660 discloses a reducing hot rolling oil for copper and copper alloys comprising a major quantity of water, at least one member selected from carboxylic acid type, sulfate type and phosphate type anionic surface active agents, and at least one other member being a hydroxyl group containing compound selected from alcohols, alkylene glycols and glycol ethers.

It is an object of the present invention to provide a novel water base metal working lubricant which is highly efficacious in use and which combines both a water soluble component and a water emulsifiable component.

It is another object of the present invention to provide a novel metal working composition which provides a water base lubricant including a water soluble component having a reverse solubility curve, an emulsifiable high pressure lubricating component and an emulsifier for the latter.

It is another object of the present invention to provide a water base metal working lubricant which displays the stability characteristics typical of water soluble type lubricants and the uniform performance characteristics typical of the emulsion type lubricants in a lubricant of superior performance characteristics. Other objects and advantages of the present invention will be apparent from the following description thereof.

SUMMARY OF THE INVENTION

A water base metal working lubricant comprises the following ingredients. From 1 to 40 parts by weight of at least one water soluble polyalkylene glycol having a molecular weight of at least 200; 1 to 35 parts by weight of at least one water emulsifiable high pressure lubricating ingredient selected from the class consisting of chlorinated paraffins, sulfurized esters of fatty acids and chlorinated esters of fatty acids; at least one noncationic emulsifier present in at least the amount necessary to emulsify said high pressure lubricating ingredient in water; and sufficient water to comprise from about 10 percent to 96 percent by weight of said lubricant.

The emulsifier may be selected from the class consisting of salts of fatty acid ester sulfonates, salts of fatty acid ester sulfates, salts of organic acid phosphates and esters of fatty acids and is preferably present in the amount of about 0.2 to 12 parts by weight.

The metal working lubricant may further include at least about 2 parts by weight polyisobutylene and the polyalkylene glycol is preferably a polypropylene glycol/polyethylene glycol block copolymer.

For example, the block copolymer may have a polyethylene group at each end of polypropylene chain of at least 600 molecular weight, or may have a polypropylene group at each end of a polyethylene chain of at least 600 molecular weight.

The metal working lubricant may further include minor amounts of at least one of a metal corrosion inhibitor and a bactericide, or other conventional additives.

The metal working lubricant emulsifier may be selected from one or more of metal salts of fatty acid sulfonates wherein the metal is sodium, potassium, calcium, magnesium or barium.

Certain objectives of the present invention are attained when the water base metal working lubricant is comprised as follows. A water soluble component comprising 1 to 40 parts by weight of at least one water soluble polyalkylene glycol having a molecular weight of at least 200, exhibiting reverse solubility in water and having the general formula:

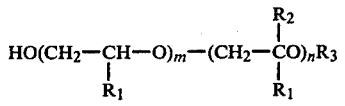

wherein $R_1$ is H, $CH_3$, or $C_2H_5$, $R_2$ is H, or $CH_3$; $R_3$ is H, $CH_3$, $C_2H_5$, $C_3H_7$, or $C_4H_9$; m=3 to 30 and n=1 to 30.

A high pressure emulsifiable component comprising 1 to 30 parts by weight of at least one high pressure water emulsifiable lubricating component selected from the class consisting of chlorinated paraffins, sulfurized esters of fatty acids and chlorinated esters of fatty acids.

An emulsifier comprising 0.2 to 12 parts by weight of at least one noncationic emulsifier for the high pressure lubricating component, the emulsifier being selected from the class consisting of salts of fatty acid sulfonates, salts of organic acid phosphates and esters of fatty acids;

The water base being present in an amount sufficient to comprise from about 10 percent to 96 percent by weight of the lubricant.

DESCRIPTION OF THE PREFERRED EMBODIMENTS

The water soluble component of the lubricant of the invention comprises a water soluble polyalkylene glycol having a molecular weight of at least 200. It is essential that the polyalkylene glycols employed in the lubricant of the invention exhibit in water a reverse solubility. That is, at the temperatures which the water base lubricant encounters when employed in metal working operations the solubility of the polyalkylene glycols employed must decrease with increasing temperature. Polyalkylene glycols of at least 200 molecular weight exhibit this phenomenon. Thus, in metal working operations when the lubricant comes in contact with a particularly hot spot of the metal, such as a cutting tip or edge, the high temperature at that point will cause the polyalkylene glycol to precipitate onto the hot metal spot to provide a protective, cooling and lubricating film. Polyalkylene glycols below a molecular weight of about 200 are so soluble in water that this highly desirable reverse solubility precipitating effect is not obtained, at least not to a sufficient degree at metal working temperatures.

The polyalkylene glycols should be sufficiently soluble to dissolve in the water and yet precipitate when exposed to a sufficiently high temperature, depending upon the particular metal working operation for which a specific lubricant formulation is intended.

While many polyalkylene glycols are suitable, polypropylene glycol and polyethylene glycol are preferred. The solubility in water of polyalkylene glycols in general depends upon their molecular weight. For example, at molecular weights below about 400 polypropylene glycol is soluble in water at room temperature in all proportions. At a molecular weight range of about 400 to 800 it is only partly soluble, i.e., soluble in same proportions which decrease with increasing molecular weight. At a molecular weight above about 800 polypropylene glycol is insoluble in water at room temperature and, if used, must be employed as a block copolymer with polyethylene glycol to get it into solution. Polyethylene glycol is much more soluble in water than is polypropylene glycol at a given molecular weight, but its solubility in water similarly decreases with increasing molecular weight.

It is possible, therefore, to control the local temperatures at which substantial precipitation of the polyalkylene glycol takes place by selecting appropriate polyalkylene glycols of given molecular weight range. Mixtures of two or more different polyalkylene glycols may be employed to provide precipitation over a selected range of temperatures.

A particularly effective and preferred polyalkylene glycol is a block polymer of polypropylene glycol/polyethylene glycol. One such is sold by the Union Carbide Corporation under the designation UCON ML-566 and comprises a polypropylene glycol/polyethylene glycol block copolymer. Another source of such block copolymers are those sold by BASF Wyandotte under the general description of "pluronic polyols." The above mentioned copolymers comprise a poly(oxypropylene) glycol chain having a poly(oxyethylene) glycol chain at either end. Alternatively, a polyoxyethylene chain may have a polyoxypropylene chain on either end.

The end chain components, whether polyethylene glycol or polypropylene glycol by themselves, may, of course, be substantially below a molecular weight of 200 provided by the molecular weight of the block polymer molecule itself is at least 200. That is, the end chains attached to either end of the central chain of the block copolymer and the intermediate chain itself may each be less than 200 molecular weight provided the total molecular weight is 200 or more.

Polyethylene glycol of over about 4,000 molecular weight is a solid, but still soluble in water. Polypropylene glycol becomes extremely viscous at high molecular weights, for example 8,000 to 10,000.

While, as indicated above, any water soluble polyalkylene glycol of molecular weight greater than 200 and which exhibits a reverse solubility temperature characteristic suitable, preferably polyalkylene glycols of the following general formula are preferred for use in the lubricant of the invention.

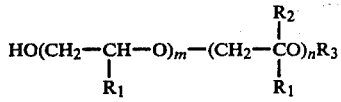

wherein $R_1$ is H, $CH_3$, or $C_2H_5$, $R_2$ is H, or $CH_3$; $R_3$ is H, $CH_3$, $C_2H_5$, $C_3H_7$, or $C_4H_9$; m=3 to 30 and n=1 to 30.

The water emulsifiable high pressure lubricating ingredient of the lubricant of the invention may be one or more of a chlorinated paraffin, sulfurized fatty acid esters or chlorinated fatty acid esters. Each of these classes of compounds exhibit lubricating abilities even at the high pressures encountered in metal working operations.

Chlorinated paraffin compounds have the advantage that at high temperatures, about 400° C. or higher, chlorinated paraffins will decompose at least partially to yield hydrochloric acid which attacks iron to form iron chlorides. This is a useful property in the metal working of iron containing metals since the iron chlorides form at hot spots on the metal and provide an iron chloride layer of excellent lubricating qualities. Chlorinated aromatic compounds are too stable to undergo such partial decomposition and further are highly poisonous and/or carcinogenic so that their use is restricted by various governmental regulations.

Generally, any chlorinated paraffin which is emulsifiable in water by a non-cationic emulsifier in the proportions required by the invention is suitable. However, paraffinic compounds of the following general formula have been found to be particularly suitable for use in the water base lubricant of the invention.

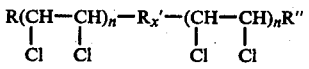

wherein R is $CH_3$, $C_2H_5$, $C_3H_7$ or $C_4H_9$; R' is $CH_2$ or $C_2H_4$; R'' is H, $CH_3$, $C_2H_5$, $C_3H_7$ or $C_4H_9$; n=1, 2 or 3 and x=0, 1 or 2.

Unsaturated Fatty acid esters which have been either sulfurized or chlorinated are also suitable as high pressure lubricating components of the invention. Generally, sulfurized fatty acid esters are excellent extreme pressure lubricating components and are stable at temperatures up to about 750° C. Chlorinated fatty acid esters similarly have excellent high pressure lubricating properties but are stable only at temperatures up to about 450° C. Although the sulfurized fatty acid esters exhibit a higher range of temperature stability, they tend to stain copper or copper based alloys whereas the chlorinated fatty acid esters do not. Selection of an appropriate chlorinated fatty acid ester or mixture of two or more is therefore indicated by lubricants intended for use on copper or copper base alloys whereas, when higher temperatures are likely to be encountered and/or if staining of copper is not a factor, then an appropriate sulfurized fatty acid ester or mixture of two or more would be indicated.

Generally, oleic acid is preferred as the fatty acid because it is relatively inexpensive. Obviously, other fatty acids may be employed. In fact, commercially available fatty acids are usually not pure, but comprise a mixture of two or more fatty acids, reflecting the fact that naturally occurring fatty acids are usually mixtures of fatty acids. Thus, oleic acid is usually admixed with other fatty acids. For example, linoleic, linolenic and erucic acid are among commonly employed fatty acids which are reacted with alcohols to form fatty acid esters. For purposes of the present invention, methyl alcohol is preferred as the esterifying alcohol for the fatty acid for use as a high pressure lubricant component because it has been found to provide enhanced wetting ability to the sulfurized or chlorinated fatty acid ester.

As is known, to obtain a sulfurized fatty acid ester, an unsaturated fatty acid ester, either manufactured or perhaps a naturally occurring glycerol ester is heated with flowers of sulfur with the result that unsaturated bonds in the fatty acid ester were attached by the sulfur to produce a sulfurized fatty acid ester. Those fatty acid esters having unsaturated carbon atoms are required for the reaction. Suitable esters for this reaction include those of methyl or ethyl alcohol or mixtures thereof. Diols, triols, glycoethers, etc. may also be employed as described below.

While any sulfurized fatty acid ester as described is suitable in accordance with the invention, a preferred sulfurized fatty acid ester has the following general formula

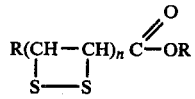

wherein R is any one of H, $CH_3$, $C_2H_5$, $C_3H_7$ or $C_4H_9$ and each R may be the same or different, and n=1, 2 or 3. Although the above formula is the most probable, the following may also occur:

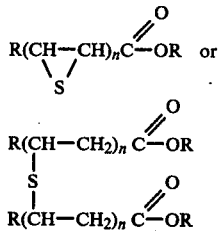

wherein R and n are the same as above given.

The chlorinated fatty acid esters are prepared in substantially the same fashion, the unsaturated fatty acid being chlorinated and then esterified with a suitable alcohol. While any chlorinated fatty acid ester as described is suitable in accordance with the invention, a preferred chlorinated fatty acid ester has the following general formula.

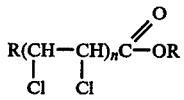

wherein R is any one of H, $CH_3$, $C_2H_5$ or $C_3H_7$ or $C_4H_9$ and each R may be the same or different, and n=1, 2 or 3.

A third component of the water base lubricant in accordance with the invention comprises a non-cationic emulsifier, i.e., either an anionic or a non-ionic emulsifier capable of emulsifying high pressure lubricating component in water. Any suitable non-cationic emulsifier may be used. However, metallic salts of fatty acid ester sulfates, or sulfonates, or salts of organic acid phosphates or esters of fatty acids are preferred. Cationic emulsifiers are acidic and would have a tendency to attack metals on which the lubricant is employed.

Suitable unsaturated fatty acids which may be esterified to provide an emulsifier are any one or more of oleic, linoleic, linolenic, erucic, lauroleic, myrsitoleid, palmitoleic, ricinoleic, licanic, eleosteric, eicosenoic, tetracosenoic, docosapolyenoic and tetracosapolyenoic acids. Those of the foregoing fatty acids which have unsaturated carbon atoms may be employed as the sulfurized or chlorinated fatty acid high pressure lubricating component.

Any one or more of the foregoing may be esterified by a suitable alcohol, polyol, diol, triol or glycoether to provide a suitable fatty acid ester emulsifier. Some examples of such fatty acids of various classes of alcohols are as follows:

| Alcohol Class | Fatty Acid Ester |
|---|---|
| Alcohol | dodecyl acetate |
| Alcohol | octyl linoleate |
| Diol | neopentyl glycol monoeleostearate |

-continued

| Alcohol Class | Fatty Acid Ester |
|---|---|
| Triol | glycerol dilaurate |
| Polyol | sorbitol monooleate |
| Polyglycol | polyethyleneglycol (600) palmitate |
| Glycolether | tetraethylene glycol monobutyl ether stearate |

The emulsifier may also be provided by metallic salts of fatty acid sulfates or sulfonates.

To make the fatty acid ester sulfonate or sulfate salts, esterified unsaturated fatty acids, such as those listed on pages 12 and 13 are reacted with sulfuric acid. Depending on the concentration of the sulfuric acid employed and the reaction conditions, a fatty acid sulfonate or sulfate or mixture may be obtained, as is well known in the art. The sulfonate is preferred as having somewhat better emulsifying properties.

As is well known, generally, the use of concentrated sulfuric acid, 96 percent by weight $H_2SO_4$ or higher generally yields predominantly the fatty acid ester sulfonate typified by the formula—$CH_2$—CHOH—$SO_3H$. Use of more dilute sulfuric acid results in increasing proportions of the fatty acid ester sulfate being formed, typified by the formula—$CH_2$—$CH_2SO_4H$.

The resultant fatty acid ester sulfate or sulfonate is then reacted with a suitable metallic base such as, for example, sodium hydroxide, to yield the sodium salt. Generally, the sodium, potassium, calcium, magnesium or barium salt of the acid ester sulfate or sulfonate is preferred. Thus, any one of the described metallic salts of any one of the above listed fatty acid ester sulfonates or sulfates will be suitable in accordance with the invention as a non-cationic emulsifying agent for the specified high pressure lubricants.

Salts of organic acid phosphates have also been found to be useful as emulsifiers for the high pressure lubricating components. The organic acid phosphate salts are obtained by reacting any organic alcohol, such as an alcohol, diol, or triol, or glycol ether, with phosphoric acid and neutralizing the reaction product with, for example, an amine, to provide, for example, an organic salt of a phosphoric acid ester. Such emulsifiers are well known in the art. For example, the reaction product of polyethylene glycol monobutylether and an amine such as triethanol amine is suitable.

Generally, it is to be understood that any known non-cationic emulsifier capable of emulsifying in water the specified high pressure lubricating component is suitable. The emulsifier need be present only in the amount needed to emulsify all the high pressure lubricating components. Excess amounts are tolerable, but not necessary or particularly useful.

The following examples illustrate some efficacious embodiments of the invention.

EXAMPLE 1

| Ingredient | Percent by Weight |
|---|---|
| (1)Keil Base 141 | 45 |
| (2)50 HB-660 | 45 |
| Tridecyl acid phosphate | 5 |
| Triethanolamine | 5 |
| Water (Three times the volume of the other ingredients) | — |

(1)Supplied by Keil Division of Ferro Corporation, Hammond, Indiana. Keil Base 141 is about 25% by weight sulfonized and 75% by weight chlorinated fatty acid esters and includes sufficient sodium salts of fatty acid sulfonates to emulsify the esters in water.

(2)A polyalkylene glycol of over 200 molecular weight supplied by Union Carbide Corporation.

The lubricant of Example 1 is in concentrated form. To save shipping costs it is convenient to prepare the lubricants of the invention in concentrated form and to further dilute with water at the point of use. In one application, the concentrated lubricant of Example 1 was further diluted with an additional 10 volumes of water to one volume of the concentrated lubricants and used as a lubricant in a broaching operation. A small part made of an exotic aircraft material containing high percentages of nickel and molybdenum was being broached to a new shape. In previous applications these broached parts, which required 100% inspection, had been so hot coming out of the oil lubricated broach that the inspector had to wait five or ten minutes before measuring them. Immediately upon the change to the diluted version of the Example 1 embodiment of the invention, the parts came out at room temperature and continued to do so. Further, the finish on the parts was markedly improved. After several days of operation the life of the broach cutting edge had more than doubled as compared to operation with the oil lubricant.

In another operation, the 10 to 1 diluted material obtained from the material of Example 1 was further diluted with fifteen volumes of water to one volume of the 10 to 1 material, and the resultant lubricant used as a cutting fluid in a different broaching operation on a variety of different metals with varying degrees of hardness. After several weeks of operation, tool life more than doubled as compared to the experience with a prior lubricant.

EXAMPLE 2

| Indgredient | Parts by Weight |
|---|---|
| (1)Keil Base 141 | 70 |
| (2)50 HB 660 | 20 |
| (3)Actrofos 139 | 2 |
| (4)Armeen DMSD | 2 |
| (5)Indopol L-14 | 6 |
| Water (Ten times the volume of the other ingredients) | — |

(1) and (2)Same comment as Example 1.

(3)A surfactant comprising an acid phosphate ester of a long chain alcohol supplied by the Arthur C. Trask Co.

(4)A tertiary amine formed from a soya acid.

(5)An unsaturated synthetic polyhydrocarbon with an average molecular weight of about 300, supplied by Amoco Chemical Co.

The composition of Example 2 was employed as the lubricant on a deep drawing operation making lipstick container covers. This operation required extremely bright finish in high detail in the finished process. Previously, no water based material was successful in this application. Parts had also been noticeably warm when they came from the machine and accumulated a difficult to remove film of oil. Immediately upon the switch to the material of Example 2 the parts come out cooler and the cleaning process was no longer required. The parts were consistently produced at considerable savings to the manufacturer. Although the blush of less bright surface did not disappear, it required less buffing to remove than was required with the old lubricant.

EXAMLE 3

| Ingredient | Percent by Weight |
|---|---|
| (1)Keil Base 141 | 65 |
| (2)50 HB-660 | 25 |
| (3)Actrofos 139 | 1 |
| (4)Sul-Perm 18 | 8 |
| Triethanolamine | 1 |
| Water (Two and one-half times the volume of the other ingredients) | — |

(1), (2) and (3)Same comment as Example 2.
(4)A mixture of sulfurized fatty acid esters developed as a replacement for sulfurized sperm oils, supplied by Keil Chemical division of Ferro Corporation.

The material of Example 3 was employed in a blanking operation involving the stamping of table ware from stainless steel. Such operations usually require heavy oils often containing kerosene which causes dermatitis to the operators. Also, tool life was not as long as desired by this manufacturer. Previously encountered difficulties of sticking and twisting were eliminated and tool life was extended along with complete elimination of the extreme cleaning difficulties which had been experienced with oil.

The manufacturer's specifications for the above mentioned products identified by manfacturer's code or trademark are as follows:

| | |
|---|---|
| Keil Base 141 | |
| Viscosity, SUS 100° F. | 1700 |
| SUS 210° F. | 98 |
| Specific Gravity, B/ML., 77° F. | 1.11 |
| | 9 |
| Weight, Lbs/Gal., 77° F. | 9.3 |
| Pour Point, °F. | 30 |
| Volatile Alcohols | None |
| Chlorine, % | 24 |
| SUL-PERM 18 | |
| Sulfur, % | 17 |
| Viscosity at 100° F. SUS | 3134 |
| Viscosity at 210° F. SUS | 278 |
| Flash Point, °F., COC | 450 |
| Fire Point, °F., COC | 490 |
| Copper Corrosion, 10% Blend ASTM D-130 | 4 |
| Weight, Lbs./Gal. | 8.4 |
| Color, ASTM, 2 ¼% | 8 |
| ACTRAFOS 139 - Phosphate ester surfactants | |
| Solubility in water | S |
| Solubility in mineral oil | S |
| pH (1% in water) | 2.0 |
| Density (1 lb/gal) | 9.1 |
| Acid No. to pH 5.3 | 127 |
| Acid No. to pH 9.3 | 212 |

Still other efficacious embodiments of the invention are illustrated by the following examles.

EXAMPLE 4

| Ingredient | Parts by Weight |
|---|---|
| A water soluble polyglycol having a molecular weight of at least 200 | 1–40 |
| A sulfurized fatty acid ester | 2–25 |
| A non-cationic emulsifier for the fatty acid ester | .05–6 |
| Tridecyl acid phosphate | 0.1–5 |
| Triethanolamine | 0.1–5 |
| Water (Sufficient to comprise from 10% to 96% by weight of the lubricant) | — |

-continued

| Ingredient | Parts by Weight |
|---|---|
| the lubricant) | |

EXAMPLE 5

| | |
|---|---|
| A water soluble polyglycol of at least 200 molecular weight | 2–20 |
| A sodium salt of a sulfonated fatty acid ester | 2–12 |
| A chlorinated fatty acid ester | 5–25 |
| An acid phosphate ester of an alcohol | 0.1–5 |
| A tertiary fatty amine | 0.1–5 |
| An unsaturated synthetic polyhydrocarbon | 1–20 |
| Water (Sufficient to comprise from 10% to 96% by weight of the lubricant) | — |

EXAMPLE 6

| Ingredient | Parts by Weight |
|---|---|
| Polyisobutylene | 2–15 |
| A chlorinated hydrocarbon | 2–25 |
| A sulfurized ester of a fatty acid | 2–25 |
| A mixture of mono and dioctyl phosphate | 0.1–5 |
| Triethanol amine | 0.1–5 |
| A water soluble polyalkylene glycol of at least 200 molecular weight | 1–30 |
| Glycerol monooleate | 1–10 |
| Water (Sufficient to comprise from 10% to 96% by weight of the lubricant) | — |

EXAMPLE 7

| Ingredient | Parts by Weight |
|---|---|
| A water soluble polyalkalene glycol of at least 200 molecular weight | 2–20 |
| A mixture of sorbitol oleate and polyethylene glycol oleate | 0.5–10 |
| A sulfurized fatty acid ester of glycerol | 4–25 |
| The ammonium salt of dinonylnapthalene sulphonic acid | 0.2–2 |
| Polyisobutylene | 2–18 |
| A triazine type bactericide | 0.1–1 |
| Water (Sufficient to comprise from 10% to 96% by weight of the lubricant) | — |

Generally, a preferred non-cationic emulsifier in any of the above examples 4–7 is a salt of an organic acid phosphate, an ester of a fatty acid, or one or more of metal salts of fatty acid ester sulfonates wherein the metal is sodium, potassium, calcium, magnesium or barium. Similarly, a preferred unsaturated synthetic polyhydrocarbon is one of the general formula:

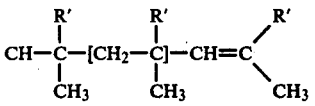

wherein R′ is H, $CH_3$ or $C_2H_5$ and each R′ may be the same or different. A preferred tertiary fatty amine is one of the general formula $$RN(CH_3)_2$$

wherein R is $C_nH_{2n+1}$, n=4 to 20, or $C_nH_{2n-1}$, n=6 to 20.

The lubricant may be prepared with any amount of water from 10% to 96% by weight.

It will be apparent that modifications and additions can be made to the lubricant composition of the present invention without departing from the scope thereof. For example, minor amounts (anything up to about 5% by weight of the most concentrated composition, i.e., one with only 10% by weight water) of conventional ingredients may be added for specific purposes, such as bactericides, dyes, colors, low molecular weight hydrocarbons, etc.

What is claimed is:

1. A water base metal working lubricant comprising about:

(a) 1 to 40 parts by weight of at least one water soluble polyalkylene glycol having a molecular weight of at least 200;

(b) 1 to 35 parts by weight of at least one water emulsifiable high pressure lubricating ingredient selected from the class consisting of chlorinated paraffins, sulfurized esters of unsaturated fatty acids and chlorinated esters of unsaturated fatty acids;

(c) at least one non-cationic emulsifier present in at least the amount necessary to emulsify said high pressure lubricating ingredient in water; and (d) sufficient water to comprise from about 10 percent to 96 percent by weight of said lubricant, said high pressure lubricating ingredient being emulsified in said lubricant.

2. The metal working lubricant of claim 1 wherein said emulsifier is selected from the class consisting of salts of fatty acid ester sulfonates, salts of fatty acid ester sulfates, salts or organic acid phosphates and esters of fatty acids and is present in the amount of about 0.2 to 12 parts by weight.

3. The metal working lubricant of claim 1 further including at least about 2 parts by weight polyisobutylene.

4. The metal working lubricant of claim 1 wherein said polyalkylene glycol is a polypropylene glycol/polyethylene glycol block copolymer.

5. The metal working lubricant of claim 4 wherein said block copolymer has a polyethylene group at each end of a polypropylene chain of at least 600 molecular weight.

6. The metal working lubricant of claim 4 wherein said block copolymer has a polypropylene group at each end of a polyethylene chain of at least 600 molecular weight.

7. The metal working lubricant of claim 4 further including at least about 5 parts by weight polyisobutylene.

8. The metal working lubricant of claim 1 further including minor amounts of at least one of a metal corrosion inhibitor and a bactericide.

9. A water base metal working lubricant comprising about:

(a) 1 to 40 parts by weight of a water soluble polyalkylene glycol having a molecular weight of at least 200;

(b) 1 to 20 parts by weight of a sulfurized unsaturated fatty acid ester;

(c) 2 to 25 parts by weight of a chlorinated unsaturated fatty acid ester;

(d) 0.05 to 6 parts by weight of a non-cationic emulsifier for said sulfurized fatty acid ester and said chlorinated fatty acid esters;

(e) 0.1 to 5 parts by weight of tridecyl acid phosphate;

(f) 0.1 to 5 parts by weight of triethanolamine; and (g) sufficient water to comprise between about 10 percent to 96 percent by weight of said lubricant, said sulfurized fatty acid ester and said chlorinated fatty acid ester being emulsified in said lubricant.

10. The metal working lubricant of claim 9 wherein said emulsifier is selected from one or more of metal salts of fatty acid ester sulfonates wherein said metal is sodium, potassium, calcium, magnesium or barium.

11. A water base metal working lubricant comprising about:

(a) 2 to 20 parts by weight of a water soluble polyalkylene glycol of at least 200 molecular weight;

(b) 2 to 12 parts by weight of a metallic salt of a sulfonated unsaturated fatty acid ester;

(c) 5 to 25 parts by weight of a chlorinated unsaturated fatty acid ester;

(d) 0.1 to 5 parts by weight of an acid phosphate ester of an alcohol having the general formula R′OH wherein R′ is a hydrocarbon having 4 to 18 carbon atoms;

(e) 0.1 to 5 parts by weight of a tertiary fatty amine of the general formula:

$$RN(CH_3)_2$$

wherein R is $C_nH_{2n+1}$, n=4 to 20, or $C_nH_{2n-1}$, n=6 to 20;

(f) 1 to 20 parts by weight of an unsaturated synthetic polyhydrocarbon of the general formula:

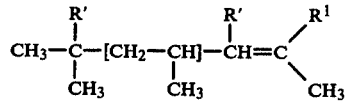

wherein R′ is H, $CH_3$ or $C_2H_5$ and each R′ may be the same or different; and (g) sufficient water to comprise between about 10 percent to 96 percent by weight of said lubricant, said chlorinated fatty acid esters being emulsified in said lubricant.

12. The metal working lubricant of claim 11 wherein said metal of said metallic salt of a sulfonated fatty acid ester is sodium, potassium, calcium, magnesium or barium.

13. The metal working lubricant of claim 11 wherein said synthetic polyhydrocarbon has an average molecular weight of about 300.

14. A water base metal working lubricant comprising about:

(a) 2 to 15 parts by weight polyisobutylene;

(b) 2 to 25 parts by weight of a chlorinated hydrocarbon;

(c) 2 to 25 parts by weight of a sulfurized ester of an unsaturated fatty acid;

(d) 0.1 to 5 parts by weight of a mixture of mono and dioctyl phosphate;

(e) 0.1 to 5 parts by weight triethanol amine;

(f) 1 to 30 parts by weight of a polyalkylene glycol of at least 200 molecular weight;

(g) 1 to 10 parts by weight of glycerol monooleate; and (h) sufficient water to comprise from about 10 percent to 96 percent by weight of said lubricant, said chlorinated hydrocarbon and said sulfurized ester of a fatty acid being emulsified in said lubricant.

15. The metal working lubricant of claim 14 wherein said polyisobutylene has an average molecular weight of about 300.

16. The metal working lubricant of claim 14 wherein said polyalkylene glycol comprises polypropylene glycol of between about 200 to 800 molecular weight.

17. The metal working lubricant of claim 14 wherein said polyalkylene glycol comprises polyethylene glycol of between about 200 to 4,000 molecular weight.

18. The metal working lubricant of claim 14 wherein said polyalkylene glycol comprises a block copolymer of polypropylene glycol of between about 200 and 8,000 molecular weight and polyethylene glycol of between about 200 and 4,000 molecular weight.

19. A water base metal working lubricant comprising about:

(a) 1 to 40 parts by weight of at least one water soluble polyalkylene glycol having a molecular weight of at least 200 and exhibiting reverse solubility in water, said polyalkylene glycol having the general formula:

$$HO(CH_2-\underset{\underset{R_1}{|}}{CH}-O)_m-(CH_2-\overset{\overset{R_2}{|}}{\underset{\underset{R_1}{|}}{C}}O)_nR_3$$

wherein $R_1$ is H, $CH_3$, or $C_2H_5$, $R_2$ is H, or $CH_3$; $R_3$ is H, $CH_3$, $C_2H_5$, $C_3H_7$, or $C_4H_9$; m=3 to 30 and n=1 to 30;

(b) 1 to 30 parts by weight of at least one high pressure water emulsifiable lubricating component selected from the class consisting of chlorinated paraffins, sulfurized esters of unsaturated fatty acids and chlorinated esters of unsaturated fatty acids;

(c) 0.2 to 12 parts by weight of at least one noncationic emulsifier for said high pressure lubricating component, said emulsifier being selected from the class consisting of salts of fatty acid ester sulfonates, salts of organic acid phosphates and esters of fatty acids; and (d) sufficient water to comprise from about 10 percent to 96 percent by weight of said lubricant, said high pressure water emulsifiable lubricated component being emulsified in said lubricant.

20. A water based metal working lubricant comprising about:

(a) 2 to 20 parts by weight of a water soluble polyalkylene glycol of at least 200 molecular weight;

(b) 0.5 to 10 parts by weight of a mixture of sorbitol oleate and polyethylene glycol oleate;

(c) 4 to 25 parts by weight of a sulfurized unsaturated fatty acid ester of glycerol;

(d) 0.2 to 2 parts by weight of the ammonium salt of dinonylnaphthalene sulphonic acid;

(e) 2 to 18 parts by weight of polyisobutylene;

(f) 0.1 to 1 parts by weight of a triazine type bactericide; and (g) sufficient water to comprise 10 percent to 96 percent by weight of said lubricant, said sulfurized fatty acid ester of glycerol being emulsified in said lubricant.

21. The metal working lubricant of claim 20 wherein said sorbitol oleate and polyethylene glycol oleate are present in a ratio by weight of four to one.

22. The metal working lubricant of claim 21 wherein said polyisobulylene has a molecular weight of about 300.

* * * * *